US006282719B1

(12) United States Patent
Vera et al.

(10) Patent No.: US 6,282,719 B1
(45) Date of Patent: Sep. 4, 2001

(54) MATERNITY-NURSING NIGHTGOWN

(76) Inventors: Carol Ann Vera, 665 Lomitas Pl.; Lori Denise Tucker, 2216 Golf Club Rd., both of Pittsburg, CA (US) 94565

( * ) Notice: Subject to any disclaimer, the term of this patent is extended or adjusted under 35 U.S.C. 154(b) by 0 days.

(21) Appl. No.: 09/618,266

(22) Filed: Jul. 18, 2000

(51) Int. Cl.[7] ..... A41C 3/08
(52) U.S. Cl. ..... 2/78.1; 2/104
(58) Field of Search ..... 2/78.1, 78.4, 114, 2/104, 70, 73, 105, 106

(56) References Cited

U.S. PATENT DOCUMENTS 3,176,692 * 4/1965 Marino ..... 450/1
3,449,763 * 6/1969 Grate ..... 2/73
4,648,404 * 3/1987 Clark ..... 450/31
5,624,296 * 4/1997 Weber-Unger ..... 450/36

* cited by examiner

*Primary Examiner*—Gloria M. Hale

(57) ABSTRACT

This invention is a combination nightgown and bra for women after pregnancy that enables the wearer to conveniently and comfortably nurse her baby by unsecuring a flap on either cup and resecuring upon completion of nursing, without the necessity of dealing with various articles of clothing and putting them on and taking them off. The gown can also be worn during pregnancy for support.

4 Claims, 2 Drawing Sheets

FIG.1
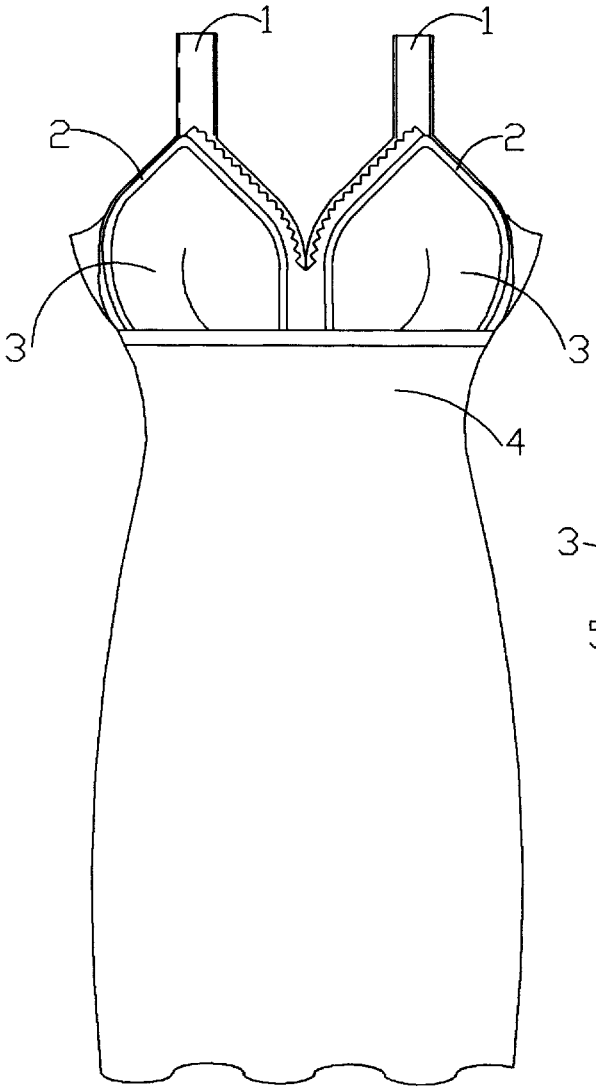
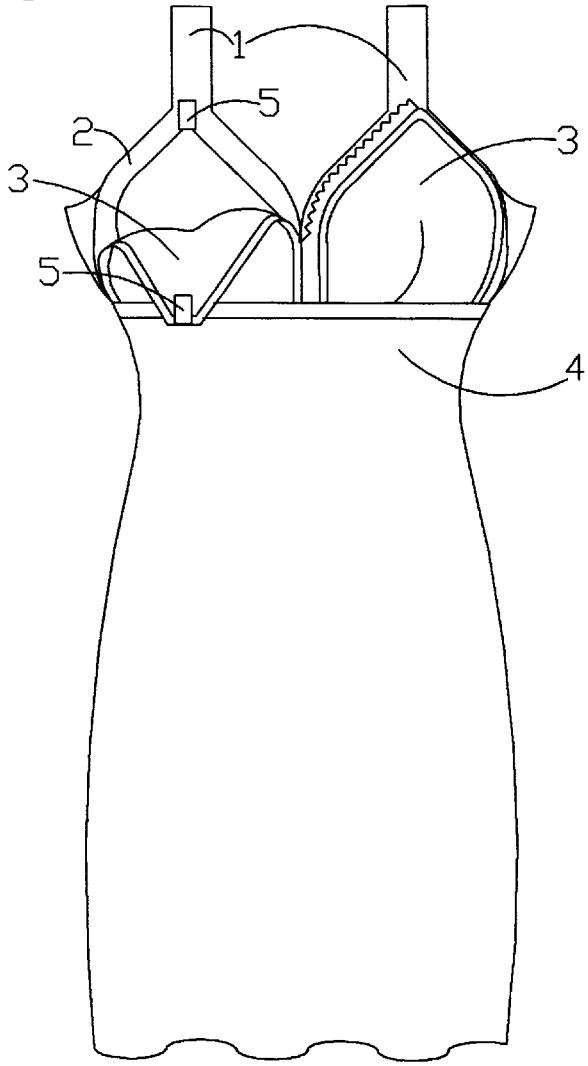
FIG.2

FRONT VIEW

EXPLODED VIEW

FRONT VIEW
W/FLAP OPEN

MATERNITY-NURSING NIGHTGOWN

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

Nursing a baby has been difficult and awkward for women while wearing clothing because it requires changing into a dress, shirt, or blouse that can be used for that purpose, while wearing a special nursing bra.

1. Field of the Invention

Women's Clothing

2. Description of the Related Art

U.S. Pat. No. 3,176,692 is a bra which is attached to a covering garment such as a slip, nightgown, etc.

U.S. Pat. No. 3,449,763 is a nursing slip and combination maternity and nursing slip that offers no breast support.

U.S. Pat. No. 4,648,404 is a nursing slip and bra which in many cases requires an outer garment to go over it, or it cannot be comfortably worn while sleeping or nursing in bed.

U.S. Pat. No. 5,624,296 is a nursing bra without being part of any other garment.

This invention is an improvement over the previous inventions, in particular U.S. Pat. No. 3,176,692, which requires a bra to be worn which is separate from a covering garment such as a slip, nightgown, etc. This invention does not require a separate bra which may be uncomfortable and inconvenient for a nursing woman to wear, but instead is a soft, comfortable, single garment that is more convenient, especially since it does not require a nursing woman to sleep in her bra 24 hours a day.

Whereas U.S. Pat. No. 3,176,692 is constructed using a regular bra as a foundation, which means the wearer would have to preselect an exact size, this invention enables the garment to be worn by a woman without reference to exact cup size, but according to the small, medium or large size version of the garment Whereas U.S. Pat. No. 3,176,692 uses buckles to attach the straps to hooks, this invention uses VELCRO strips or a hook and loop fastener.

Whereas the diamond shaped member or flap in U.S. Pat. No. 3,176,692 is substantially inelastic, this invention utilizes the same soft elastic fabric as the rest of the nightgown.

Whereas U.S. Pat. No. 3,176,692 uses buckles to adjust the straps of the bra, this invention does not require buckles since the strap of the nightgown is made of the same soft elastic fabric as the rest of the nightgown, reinforced by elastic bands sewn into the edges of the straps.

Whereas U.S. Pat. No. 3,176,692 uses inelastic material for the web of the bra, this invention uses the same soft, elastic fabric as the rest of the nightgown, reinforced by elastic bands sewn into the web of the nightgown, just under the bust.

U.S. Pat. No. 3,449,763 is a nursing slip which either must be worn with an outer garment such as a dress or must be worn while sleeping which would be uncomfortable, because it is form fitting. This invention is a nightgown which is more loosely fitting, yet can be worn as an outer garment around the house or can be slept in comfortably.

Whereas U.S. Pat. No. 3,449,763 requires a slide fastener, a mechanical device which also requires special seams and flaps to protect the wearer, this invention relies on VELCRO or a hook and loop fastener which is more comfortable for the wearer, especially when sleeping.

Whereas U.S. Pat. No. 3,449,763 requires the wearer to purchase a slip in her exact size, this invention need only come in small, medium, and large sizes, thereby making only three sizes available to almost all women.

Whereas U.S. Pat. No. 3,449,763 requires cups to be built in for support of the bust, this invention supports the bust through the cut, form, and stitching of the fabric, making the support more flexible and softer, and thus more comfortable to sleep in.

U.S. Pat. No. 4,648,404 is a garment used in connection with a nursing bra for women who wish to nurse in public. This invention is a nightgown which is designed to be worn around the house or in bed.

Whereas U.S. Pat. No. 4,648,404 requires a nursing bra to be worn, this invention requires no separate bra.

U.S. Pat. No. 5,624,296 is a nursing bra, whereas this invention is a maternity nightgown with no bra.

BRIEF SUMMARY OF THE INVENTION

This invention is a combination nightgown and bra for women after preganancy that enables the wearer to conveniently and comfortably nurse her baby by unsecuring a flap on either cup and resecuring upon completion of nursing, without the necessity of dealing with various articles of clothing and putting them on and taking them off. The nightgown can be worn while sleeping or in bed, or around the house. The gown can also be worn during pregnancy for support.

BRIEF DESCRIPTION OF THE SEVERAL VIEWS OF THE DRAWINGS

FIG. 1—Front view of the garment with flaps closed.

FIG. 2—Front view of the garment with one flap open.

DETAILED DESCRIPTION OF THE INVENTION

Figure 3:
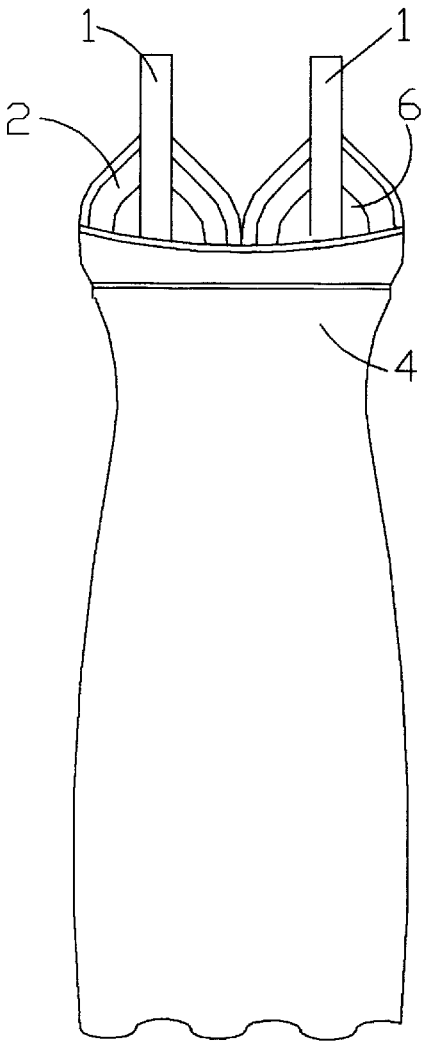
FIG. 3—Rear view of the garment.
Figure 4:
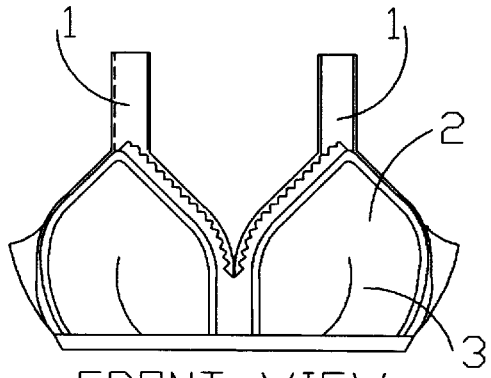
FIG. 4—Front view of upper, bra portion of garment with flaps closed.
Figure 5:
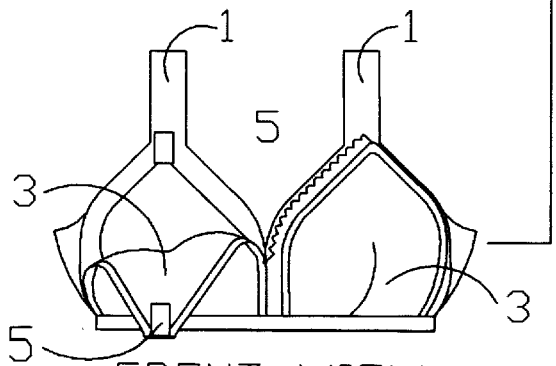
FIG. 5—Front view of upper, bra portion of garment with one flap open.

This invention is a combination nightgown and bra for women after preganancy that enables the wearer to conveniently and comfortably nurse her baby by unsecuring a flap on either cup and resecuring upon completion of nursing, without the necessity of dealing with various articles of clothing and putting them on and taking them off. The nightgown can be worn while sleeping or in bed, or around the house. The gown can also be worn during pregnancy for support.

Reference number 1—shows fabric straps with elastic inside, extending from above bodice to the back of bodice in various lengths depending on bust size.

Reference number 2—shows one layer of fabric stitched to form a triangular cup shape, and attached to the strap by stitching, and extending around the back to form a wide band varying by size. This piece is bordered on all outside edges by elastic stitched to the edges.

Reference number 3—shows fabric panels in two layers in an approximate triangular cup shape, the base of which is stitched in hinged fashion to the bodice band. The remaining two sides of the triangle are stitched with trim. The apex of the triangle has a small rectangular piece of VELCRO, hook and loop fastener material, which can be detached and attached by hand to a corresponding piece of VELCRO above the apex of the triangular opening on piece #2. A hook or similar double sided sticky material can be used in place of a hook and loop fastener.

Reference number 4—shows one layer of fabric stitched to the bodice band forming the skirt of the nightgown, the length of which varies by size and style.

Reference number 5—shows rectangular VELCRO hook and loop strips used for attachment. A hook or other fastening devices can be substituted at this location for VELCRO.

What is claimed is:

1. A nightgown for breast feeding comprising an upper bra portion including left and right bra cupflaps; left and right triangular cup supports each having a shoulder strap extending from an upper apex edge of each of said left and right triangular bra cup supports; an elastic band beneath said left and right bra cup supports which join said cup supports to a skirt portion constructed of soft elastic fabric; said left and right bra cup flaps hingedly attached at a bottom edge of said triangular bra cup supports; said straps and said skirt are all formed of soft elastic material; said left and right bra cup flaps are attached to at their upper apex to said shoulder straps by a hook and loop fastener wherein complementary hook and loop fastener components are located on each said strap and said upper bra cup flap apex edge.

2. A nightgown as claimed in claim 1 wherein said straps are constructed of soft elastic fabric which is the same as the skirt portion fabric and wherein said straps are reinforced by elastic bands sewn into the straps.

3. A nightgown as claimed in claim 1 wherein said left and right bra cup flaps are formed of the same soft elastic fabric as the rest of the nightgown.

4. A nightgown as claimed in claim 3 wherein said hook and loop fasteners are substituted with any known fastener including any one of hooks and eyes; buttons and buttonholes; snaps and adhesive tape fasteners.

* * * * *